United States Patent [19]

Cole et al.

[11] 4,358,902

[45] * Nov. 16, 1982

[54] THRUST PRODUCING SHOE SOLE AND HEEL

[76] Inventors: George S. Cole, P.O. Box 233, 17 Mile Dr., at Midway Pt., Pebble Beach, Calif. 93953; Karl M. Schmidt, 105 South Dr., Mountain View, Calif. 94040

[ * ] Notice: The portion of the term of this patent subsequent to Dec. 9, 1997, has been disclaimed.

[21] Appl. No.: 136,747

[22] Filed: Apr. 2, 1980

[51] Int. Cl.[3] ..... A43B 13/18; A43B 13/20; A43B 21/28

[52] U.S. Cl. ..... 36/28; 36/29; 36/35 B

[58] Field of Search ..... 36/28, 29, 35 R, 35 B, 36/3 R, 3 B, 30 R

[56] References Cited

U.S. PATENT DOCUMENTS

| | | | |
|---|---|---|---|
| 508,034 | 11/1893 | Moore | 36/29 |
| 547,645 | 10/1895 | Lacroix | 36/29 |
| 586,155 | 7/1897 | Bascom | 36/29 |
| 850,327 | 4/1907 | Tauber | 36/29 |
| 1,278,320 | 9/1918 | Ellithore | 36/35 B |
| 1,605,985 | 11/1926 | Rasmussen | 36/29 X |
| 2,532,742 | 12/1950 | Stoiner | 36/35 B |
| 2,549,343 | 4/1951 | Stoiner | 36/29 |
| 2,605,560 | 8/1952 | Gouabault | 36/29 |
| 2,677,904 | 5/1954 | Reed | 36/29 |
| 2,863,230 | 12/1958 | Cortina | 36/29 |
| 3,044,190 | 7/1962 | Urbany | 36/29 |
| 3,225,463 | 12/1965 | Burnham | 36/29 X |
| 3,871,117 | 3/1975 | Richmond et al. | 36/29 X |
| 4,071,963 | 2/1978 | Fukuoka | 36/3 B |
| 4,237,625 | 12/1980 | Cole et al. | 36/28 |

FOREIGN PATENT DOCUMENTS

| | | | |
|---|---|---|---|
| 73695 | 8/1917 | Fed. Rep. of Germany | 36/29 |
| 336981 | 2/1904 | France | 36/29 |
| 70141 | 8/1914 | Switzerland | 36/29 |
| 16240 | of 1893 | United Kingdom | 36/29 |
| 440398 | 10/1934 | United Kingdom | 36/29 |

*Primary Examiner*—James Kee Chi

*Attorney, Agent, or Firm*—Vogel, Dithmar, Stotland, Stratman & Levy

[57] ABSTRACT

A thrust producing shoe sole and heel having fluid-proof cavities located in the heel portion and in the sole portion which underlies the metatarsal ball area of a foot for which the sole and heel is sized, the cavities being connected by restricted passageways. The material underlying the cavities at the bottom of the sole and heel is resilient and wear-resistant. Fluid is contained within the cavities and passageways in such pressure and amount as to cause bulges below the normal bottoms of the sole and heel, whereby at rest a foot on the sole and heel is cushioned comfortably on the fluid in the bulges, and in walking and running, fluid under bulge producing pressure alternates through the passageways between the cavities, producing shock absorption and an alternate lifting effect by the sole and heel bulges which provides forward thrust both in the heel portion and in the metatarsal ball area that facilitates walking and running. The shape and disposition of the heel bulges and of the metatarsal ball area bulges are such that the sole and heel of the invention exhibits superior lateral stability.

10 Claims, 7 Drawing Figures

THRUST PRODUCING SHOE SOLE AND HEEL

CROSS-REFERENCE TO RELATED APPLICATION

The invention disclosed and claimed in this application is an improvement on the invention disclosed and claimed in our prior co-pending U.S. application, Ser. No. 943,053, filed Sept. 18, 1978, for Thrust Producing Shoe Sole and Heel, now U.S. Pat. No. 4,237,625 issued Dec. 9, 1980.

PRELIMINARY PRIOR ART STATEMENT

The closest prior art to subject invention known to applicants are those U.S. patents listed by number on page 3 of the aforesaid prior co-pending application, and the U.S. and foreign patents cited by the U.S. Patent and Trademark Office during the prosecution of the said application.

These prior U.S. and foreign patents disclose shoe soles and heels embodying pneumatic or hydraulic features of one kind or another, but applicants find that no one of them is directed to a thrust producing shoe sole and heel such as disclosed and claimed in this application or in the prior application.

Within three months following the filing date of subject application, applicants will file a formal prior art statement in accordance with Rule of Practice 1,98, which statement will treat the prior art considered closest, and may or may not treat all the patents referred to above.

BRIEF SUMMARY OF THE INVENTION

This invention, like the invention disclosed and claimed in our prior co-pending application, relates to a thrust producing shoe sole and heel suitable for use on shoes designed for men, women and children, and more particularly, to a shoe sole and heel having resilient bulges in the metatarsal ball area of the sole portion and in the heel portion.

The resilient bulges extend below the bottoms of the bulgeless areas of the sole and the heel portions, and thus in standing, walking and running come in contact with the ground or other support surface. The bulges are formed by resilient bottom walls of cavities provided in the sole and heel portions, and restricted passageways connect the several cavities. The cavities and restricted passageways contain fluid in such pressure and amount as to create the aforesaid bulges.

When at rest, the foot of the wearer of the sole and heel of the invention is cushioned comfortably on the pressurized fluid in the bulges, and in walking or running fluid under bulge producing pressure alternates through said passageways between the heel portion and sole portion bulges to absorb shock and produce an alternate lifting effect by the bulges which provide forward thrust both in the heel portion and in the metatarsal ball area of the sole portion that facilitates walking or running.

As previously mentioned, the invention of this application is an improvement over the invention described and claimed in the aforesaid prior co-pending application. In brief, the present invention contemplates a sole and heel member wherein the sole portion has a plurality of cavities underlying only the metatarsal ball area of a foot for which the member is sized, and the heel portion has at least one cavity therein. As before, the cavities are connected by restricted passageways, resilient cavity closing material overlies the cavities and is secured to the sole and heel member in fluid-proof manner, the wall of the cavities at the bottom of the sole and heel member are resilient and wear-resistant, and fluid is provided in the cavities and passageways under such pressure as to create bulges below the bottom of the member.

The plural bulges underlying the metatarsal ball area of the foot cooperates to impart improved lateral stability to the shoe sole and heel, a feature of importance to older persons, and those persons who experience weak ankles. The heel portion also is provided with one or more bulges which impart further lateral stability to the shoe sole and heel of the invention.

In more detailed aspect, the present invention, like that of the prior application, employs undercut peripheral walls in the cavities so stresses produced by the pressurized fluid in the cavities react as shear stresses rather than peel stresses on the cavity closing material, and thus assure prolonged adhesion between the cavity closing material and the sole and heel member.

Another feature of improvement in the present application resides in the provision of laterally spaced cavities in the metatarsal ball area, the sole portion or region between the cavities providing a stiffening bridge which tends positively to prevent discomforting upward bulges in the metatarsal ball area. The spaced cavities also create spaced bulge regions which impart lateral stability to the sole portion. In one form of the invention shown, the cavity closing material is secured to the stiffening bridge in fluid-proof manner, and in another form the cavity closing material is free of the stiffening bridge and thus bulges downwardly with respect to the bridge. However, in both forms, improved lateral stability is provided, as well as the tendency positively to prevent discomforting upward bulges in the metatarsal ball area.

DETAILED DESCRIPTION

Figure 1:
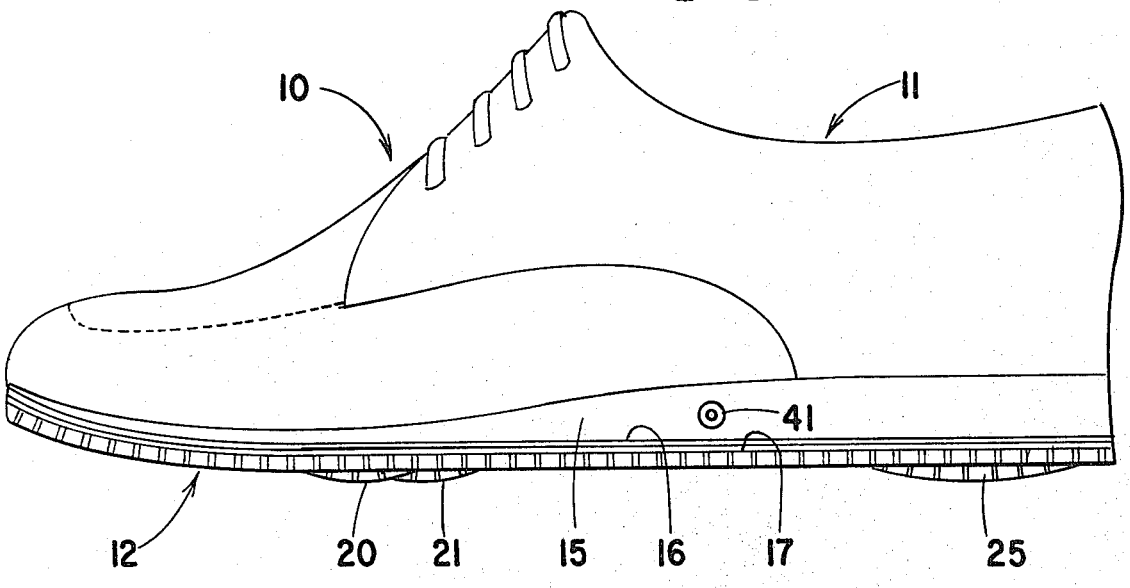
FIG. 1 is a side elevational view of a shoe embodying the thrust producing sole and heel of the present invention.

Referring to the drawings, FIG. 1 illustrates a conventional men's shoe, except for the sole and heel structure which embodies the present invention. Thus, shoe 10 includes a more or less conventional upper portion 11, and sole and heel 12 embodying the invention. As mentioned, sole and heel 12 is suitable for shoes designed for men, women and children, and is desirable for both walking and running shoes.

Figure 2:
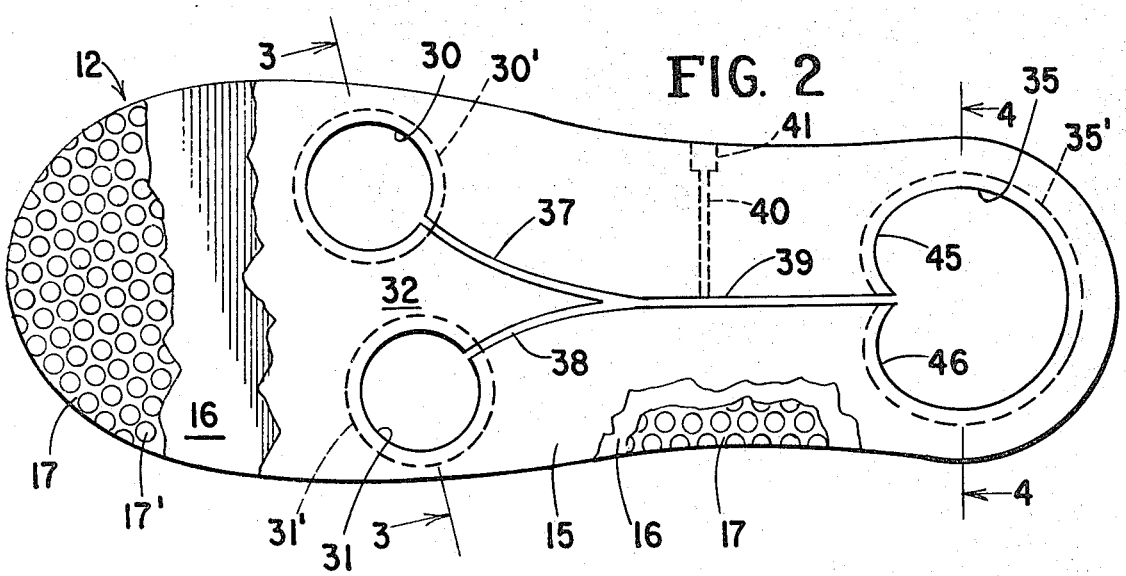
FIG. 2 is a bottom view of the shoe sole and heel shown in FIG. 1, lowermost portions of the sole and heel being partially removed for better illustration of the cavities and passageways.

Referring now to FIGS. 1 and 2, sole and heel 12, as shown, is of laminated construction, including an upper sole and heel member 15 of rubber or other suitable material, an intermediate layer of resilient cavity closing material 16, later described in greater detail, and a lower layer of resilient wear-resistant material 17. Alternatively, materials 16 and 17 may be unitary.

Figure 6:
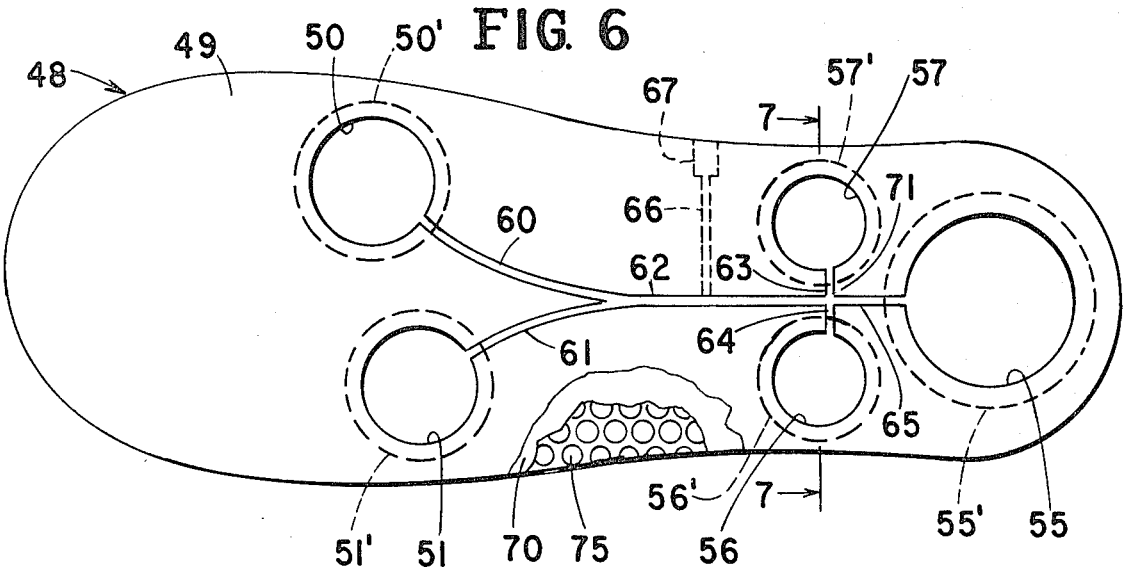
FIG. 6 is a bottom view of a modified sole and heel characterized by a plurality of cavities in the heel portion, lowermost portions of the sole and heel being partially removed for clarity.

Again referring to FIG. 1, sole and heel 12 has downwardly extending bulges 20 and 21 underlying only the metatarsal ball area of the sole portion, while the heel portion has at least one downwardly extending bulge 25. Sole portion bulges 20 and 21 are a plurality of bulges that may include more bulges, and the heel portion may have additional bulges, as shown in FIG. 6.

As presently to be described, bulges 20, 21 and 25 are connected by restricted passageways, and the bulges and passageways contain fluid under suitable pressure, e.g. 1–3 pounds per square inch, depending on the weight of the user and nature of the use. In walking and running, fluid under bulge producing pressure alternates through the passageways between the cavities and produces an alternate lifting effect by the bulges which provides forward thrust both in the metatarsal ball area and in the heel portion that facilitates walking or running.

Referring now to FIGS. 2–5, structural aspects of the bulges 20, 21 and 25 now will be described. The sole portion of upper sole and heel member 15 has a plurality of cavities underlying only the metatarsal ball area of a foot for which the member is sized. In the form of the invention shown in FIG. 2, two laterally spaced cavities 30 and 31 are provided in the metatarsal ball area, the sole material between the two cavities providing a stiffening bridge 32 which tends positively to prevent discomforting upward bulges in the metatarsal ball area. The two spaced cavities 30 and 31 also cooperate to create the laterally spaced bulges 20 and 21 (FIG. 1) which impart lateral stability to the sole portion.

The heel portion of upper sole and heel member 15 has at least one cavity therein, a single cavity 35 being shown in FIG. 2. The forward portion of cavity 35 has forwardly extending lobes 45 and 46 on opposite sides of the longitudinal axis, imparting a general heart shape to the cavity, the forwardly extending cavity lobes 45 and 46 cooperating to create bulge extensions which impart lateral stability to the heel portion.

The broken lines 30', 31' and 35' surrounding the respective cavities 30, 31 and 35 in FIG. 2 indicate that the cavities are undercut in tapering manner from the cavity openings to the cavity bottoms, whereby the cavity walls are wedge-shaped in cross section. The broken lines mark the intersections between the undercut peripheral walls and the cavity bottoms. The purpose of the undercut walls is the same as that described in the aforesaid prior application, and will be described briefly hereinafter.

Restricted passageways 37, 38 and 39, shown as grooves in sole and heel member 15, connect the cavities 30, 31 and 35 with each other and with a lateral restricted passageway 40, shown in broken line, which connects with an externally accessible valve shown diagrammatically at 41. Fluid (gas or liquid) at desired pressure is introduced through valve 41 to the passageways and cavities, thereby creating the bulges, as will be seen.

Cavity closing material 16, broken away in FIG. 2, overlies cavities 30, 31 and 35, as well as the grooves forming restricted passageways 37, 38 and 39, and is secured to sole and heel member 15 in fluid-proof manner around the cavities and passageways. Cavity closing material 16, of course, is resilient so as to permit the formation of bulges 20, 21 and 25.

Lower exterior material 17 also is resilient so as to permit formation of the bulges, as well as wear-resistant. As shown in FIG. 2, the exterior lower surface of material 17 consists of numerous wear-resistant bosses 17', the material between the bosses being resilient so as to permit the formation of the bulges. As previously mentioned, materials 16 and 17 may be unitary.

Figure 3:
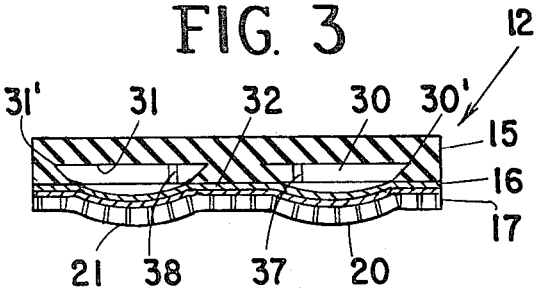
FIG. 3 is a sectional view on line 3—3 of FIG. 2, the lowermost portions of the sole being shown in place over the cavities.

Referring now to FIG. 3, the sectional view on line 3—3 of FIG. 2, the purpose of the undercut peripheral cavity wall will be described briefly. Cavity closing material 16 is secured to sole and heel member 15 among other places, on junctions in general alignment with the undercuts, whereby stresses produced by the pressurized fluid in the cavities react as shear stresses rather than peel stresses at the aforesaid junctions of member 15 with cavity closing material 16, and thus assure prolonged adhesion at the junctions. This function of the undercut walls is described more in detail in our prior application, but it is here illustrated in FIGS. 3, 4, 5 and 7 by the distortion of the edges of the cavity mouths shown in those figures.

As also more fully described in our prior application, the generally transverse center line of the metatarsal ball area of the sole portion of sole and heel 12 is positioned about ¼ inch rearwardly of the generally transverse center line of the metatarsal ball area of the foot for which the sole and heel is sized.

Figure 4:
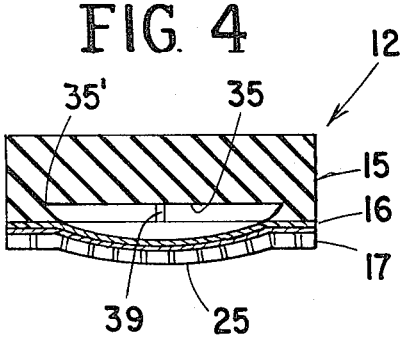
FIG. 4 is a sectional view on line 4—4 of FIG. 2, the lowermost portions of the heel being shown in place.

The sectional views shown in FIGS. 3 and 4 illustrate, respectively, the end of restricted passageway 38 as it enters cavity 31 (FIG. 3), the end of restricted passageway 37 as it enters cavity 30 (FIG. 3) and the end of restricted passageway 39 as it enters cavity 35 (FIG. 4).

Figure 5:
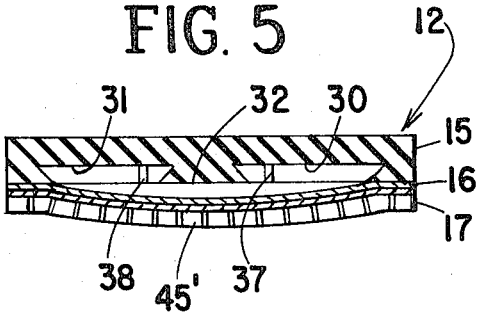
FIG. 5 is a sectional view generally like FIG. 3, except that the cavity closing material is free of the stiffening bridge between the cavities.

FIG. 5 shows a modification of the metatarsal ball area structure shown in FIG. 3. The same two laterally spaced cavities 30 and 31 are provided in the metatarsal ball area, but the cavity closing material 16 is shown free of stiffening bridge 32. Thus, cavity closing material 16 and the lower resilient wear-resistant materials 17 bulges downwardly with respect to bridge 32, as shown at 45'. However, stiffening bridge 32, as before, performs its function of tending positively to prevent discomforting upward bulges in the metatarsal ball area, and the spaced two cavities create spaced bulge regions which impart lateral stability to the sole portion.

Figure 7:
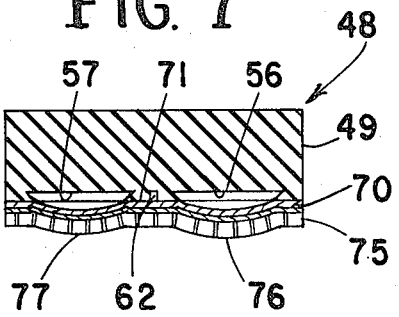
FIG. 7 is a sectional view on line 7—7 of FIG. 6, the lower heel portions being shown in place.

Referring now to FIGS. 6 and 7, a modified sole and heel 48 is shown which is characterized by a plurality of cavities in the heel portion of sole and heel member 49. Cavities 50 and 51 and undercuts 50' and 51' in the sole portion of member 49 are substantially the same as cavities 30 and 31 and undercuts 30' and 31' shown in FIG. 2.

The heel portion of the FIG. 6 modification has three cavities, namely a single rear cavity 55 and two front laterally spaced cavities 56 and 57. As before, the peripheral walls of cavities 55, 56 and 57 are undercut, as indicated by the broken lines 55', 56' and 57' surrounding the mouths of the cavities.

Restricted passageways 60, 61, 62, 63, 64 and 65 connect the respective cavities with each other and with a transverse restricted passageway 66 shown in broken line, the passageway 66 connecting with an externally accessible valve 67 through which fluid at desired pressure is introduced to the restricted passageways and the cavities.

Resilient cavity closing material 70 is secured to the sole and heel member in the space 71 between the cavities 56 and 57, as best shown in FIG. 7, whereby laterally spaced bulges 76 and 77 are formed over cavities 56 and 57, which bulges impart lateral stability to the heel portion. Resilient wear-resistant material 75, if different than material 70, underlies material 70 to engage the ground or other support surface.

Summarizing the performance of subject thrust producing shoe sole and heel, in taking a normal step, the heel bulge structure first engages the ground or other support surface with the weight of the wearer, and the heel bulge structure accordingly is reduced in size. The fluid in the heel bulge structure is communicated to the bulge structure in the metatarsal ball area, which bulge structure enlarges. In completing the step, the metatarsal bulge structure engages the ground or other support surface and transfers fluid to the heel bulge structure, thereby increasing the size of the latter. This size increase occurs slightly before and as the heel normally is being lifted from the ground, and thus produces an upward and forward thrust at the heel.

A forward thrust also occurs in the bulge structure of the metatarsal ball area as the foot rocks forwardly. This metatarsal thrust is due to the fact that the fluid in the metatarsal bulge structure, as the foot rocks forwardly, travels from the front of the bulge structure to the rear of the bulge structure, thereby causing an enlargement at the rear which produces an upward and forward thrust in that region. The restricted passageways 37, 38 and 39 cooperate in producing the metatarsal forward thrust by restricting the flow of fluid from the metatarsal bulge structure to the heel bulge structure.

From the above description, it is believed that the construction and advantages of the present invention will be readily apparent to those skilled in the art.

Various changes in detail may be made without departing from the spirit or losing the advantages of the invention.

Having thus described the invention, what is claimed as new and desired to be secured by Letters Patent is:

1. A thrust producing shoe sole and heel, comprising:

a sole and heel member including sole and heel portions, said sole portion having a plurality of cavities underlying only the metatarsal ball area of a foot for which said member is sized and said heel portion having at least one cavity therein;

said member having restricted passageways connecting said cavities;

cavity closing material overlying said cavities and secured to said member in fluid-proof manner, the walls of said cavities at the bottom of said member being resilient and wear-resistant; and fluid in said cavities and said passageways under such pressure as to create bulges below the bottom of said member;

whereby at rest a foot on said member is cushioned comfortably on the pressurized fluid in the bulges, and in walking or running fluid under bulge producing pressure alternates through said passageways between the at least one cavity of said heel portion and the plurality of cavities of said metatarsal ball area, to absorb shock and produce an alternate lifting effect by the bulges which provides forward thrust both in the heel portion and in the metatarsal ball area that facilitates walking or running.

2. The thrust producing shoe sole and heel of claim 1 wherein the peripheral walls of said cavities are undercut in tapering manner from the cavity openings to the cavity bottoms, whereby the cavity walls are wedge-shaped in cross section, said cavity closing material being secured to said member on junctions in general alignment with said undercuts, whereby stresses produced by the pressurized fluid in the cavities react as shear stresses rather than peel stresses at the said aligned junctions of said member with said cavity closing material, and thus assure prolonged adhesion at said junctions.

3. The thrust producing shoe sole and heel of claim 1 wherein said plurality of cavities underlying only the metatarsal ball area are located longitudinally of said member such that the transverse center line of the cavity area is positioned about ¼ inch rearwardly of the transverse center line of the metatarsal ball area of the foot for which said member is sized.

4. The thrust producing shoe sole and heel of claim 1 wherein said sole portion has two laterally spaced cavities, the sole portion between said cavities providing a stiffening bridge which tends positively to prevent discomforting upward bulges in the metatarsal ball area, the two cavities creating spaced bulge regions which impart lateral stability to the sole portion.

5. The thrust producing shoe sole and heel of claim 4 wherein said cavity closing material is secured to said stiffening bridge in fluid-proof manner.

6. The thrust producing shoe sole and heel of claim 4 wherein said cavity closing material is free of said stiffening bridge and thus bulges downwardly with respect to said bridge.

7. The thrust producing shoe sole and heel of claim 4 wherein said heel portion has a single cavity, the forward portion thereof having forwardly extending lobes on opposite sides imparting a general heart shape, the forwardly extending cavity lobes creating bulge extensions which impart lateral stability to said heel portion.

8. The thrust producing shoe sole and heel of claim 4 wherein said heel portion has a single rear cavity, two front laterally spaced cavities, and restricted passageways interconnecting said cavities with each other and with said cavities in said sole portion, the front laterally spaced cavities creating bulges which impart lateral stability to said heel portion.

9. The thrust producing shoe sole and heel of claim 1 wherein said heel portion has a single cavity, the forward portion thereof having forwardly extending lobes on opposite sides imparting a general heart shape, the forwardly extending cavity lobes creating bulge extensions which impart lateral stability of said heel portion.

10. The thrust producing shoe sole and heel of claim 1 wherein said heel portion has a single rear cavity, two front laterally spaced cavities, and restricted passageways interconnecting said cavities with each other and with said cavities in said sole portion, the front laterally spaced cavities creating bulges which impart lateral stability to said heel portion.

* * * * *